United States Patent [19]

Meshberg

[11] 4,389,003

[45] Jun. 21, 1983

[54] SLIDING INLET SEAL FOR AN ATOMIZING PUMP DISPENSER

[76] Inventor: Philip Meshberg, 2500 South Ocean Blvd., Palm Beach, Fla. 33480

[21] Appl. No.: 238,368

[22] Filed: Feb. 26, 1981

Related U.S. Application Data

[63] Continuation of Ser. No. 7,943, Jan. 31, 1979, abandoned.

[51] Int. Cl.[3] ..... B05B 11/00

[52] U.S. Cl. ..... 222/321; 222/380; 277/205; 277/206 R

[58] Field of Search ..... 222/321, 380, 385; 239/329, 331, 333; 277/205, 206 R

[56] References Cited

U.S. PATENT DOCUMENTS

| | | | |
|---|---|---|---|
| 2,626,839 | 1/1953 | Creson et al. | 277/205 X |
| 3,331,559 | 7/1967 | Fedit | 222/321 |
| 4,088,425 | 5/1978 | Bennett | 222/380 X |
| 4,122,982 | 10/1978 | Giuffredi | 222/321 |
| 4,144,987 | 3/1979 | Kishi | 222/321 |

FOREIGN PATENT DOCUMENTS

| | | | |
|---|---|---|---|
| 1145850 | 5/1957 | France | 277/206 |

*Primary Examiner*—Joseph J. Rolla
*Assistant Examiner*—Frederick R. Handren
*Attorney, Agent, or Firm*—Kenyon & Kenyon

[57] ABSTRACT

In an atomizing pump dispenser which includes a pump body having a pump chamber with a piston disposed for reciprocal motion therein for dispensing a fluid from the pump chamber upon depression of a dispensing stem which is operatively coupled to the piston, and in which a valve member operatively coupled to the piston closes off an inlet throat for the chamber during dispensing, the inlet throat being formed by a separate insertable flexible seal, the flexible seal is disposed at the bottom of the pump chamber in such a manner as to be slidable between two positions. In the first position, which the seal assumes when the pump stem is depressed, it abuts against the pump body to prevent communication between the pump chamber and the space below the throat. After the dispensing stroke, as the stem is pushed upward by biasing means and, with it, the valve member, the flexible seal moves to a second position in which a bypass channel is opened permitting fluid to immediately begin refilling the pump chamber from below the throat.

8 Claims, 2 Drawing Figures

SLIDING INLET SEAL FOR AN ATOMIZING PUMP DISPENSER

This is a continuation of application Ser. No. 007,943 filed Jan. 31, 1979, now abandoned.

BACKGROUND OF THE INVENTION

This invention relates to atomizing pump dispensers in general and more particularly to an improved inlet seal for a pump dispenser which seals the inlet chamber during dispensing with a surface to surface seal.

Various types of atomizing pump dispensers have been developed. The majority of these pump dispensers include a pump body in which there is formed a pump chamber, a piston disposed for reciprocal movement within the pump chamber a dispensing stem operatively coupled to the piston and adapted to receive an atomizer head, and valve means for selectively bringing the pump chamber in and out of communication with the container on which the pump is mounted. Typically, a check valve such as a ball check valve is utilized. During the dispensing stroke the pressure developed within the pump chamber closes the check valve so that material is forced out through the stem and atomizer. After dispensing, as the piston is returned to its normal position by biasing means such as a spring, the check valve opens to permit the pump chamber to refill. However, pumps have also been developed which do not utilize such a check valve. Typical of this type of pump is that disclosed and claimed in applicant's U.S. Pat. No. 4,113,145, the disclosure of which is hereby incorporated by reference. In the pump disclosed therein, a throat is formed at the bottom of the pump chamber. Upon actuation of the dispensing stem a cylindrical member makes a positive surface to surface seal with the throat to seal off the chamber from a dip tube in communication with the container. On the return stroke of the piston, the cylinder remains empty until the member making the seal reaches almost its fully raised position whereupon communication is again established between the pump chamber and the container permitting the chamber to refill.

The same manner of sealing the pump chamber is described in U.S. patent application Ser. No. 765,701 in conjunction with a prepressurized pump. In the pump of the aforementioned U.S. Pat. No. 4,113,145, and in a number of the embodiments of Ser. No. 765,701, the throat at the inlet to the pump chamber is formed by molding the throat as part of the pump body. However, in FIG. 4 of U.S. Pat. No. 4,274,560, an alternative manner of sealing is disclosed. This alternative manner comprises forming the throat by means of a flexible insertable seal. This permits making the seal member, which is inserted into the pump chamber, of a softer plastic material than the pump body itself and softer than the cylindrical member with which it makes a seal so as to obtain a better sealing effect.

Another pump of this general type is disclosed in British Pat. No. 1,486,236, in which a check valve is formed at the inlet to the pump chamber by an elastic ring closely and slidably fitted on a valve rod movable between two positions as defined by a cavity member having an annular recess larger than the outside diameter of the elastic ring.

SUMMARY OF THE INVENTION

It is the object of the present invention to provide an improved inlet seal for an atomizing dispenser which basically utilizes a surface to surface, preferably plastic to plastic, seal, but which at the same time permits refilling of the pump chamber as soon as the dispensing stroke is finished and the piston starts its return to its normal, at rest position.

Before describing the present invention it should be pointed out that for sake of convenience herein a pump which is mounted vertically on a container is used as an example. Thus, the bottom of the pump chamber will be spoken of as will the piston being raised to its uppermost position, for example. These terms are only used as matters of convenience, when explaining the drawing. In general terms, the bottom of the pump chamber is its inward end and the top of the chamber the outward end. As the piston moves toward the bottom of the chamber its moves inwardly and when it moves to its at rest position it moves outwardly. Naturally, as will be recognized by those skilled in the art, the pump can be mounted in any orientation. An example of such mounting is the trigger pump disclosed in connection with FIG. 2 of the aforementioned U.S. Ser. No. 765,701. Furthermore, although the seal of the present invention will be described in connection with an embodiment similar to that shown in FIG. 3, of U.S. Ser. No. 765,701, it should be recognized that it is generally applicable to any type of a pump which uses a surface to surface seal. Thus, it can be used with all of the other embodiments shown in application Ser. No. 765,701, as well as with the pumps described in U.S. Pat. No. 4,113,145.

In order to accomplish the objects of the present invention, the flexible seal which is inserted in the bottom of the pump chamber and which is typically of a softer plastic than the pump and the member which seals against it to form a surface to surface, generally a plastic to plastic seal, is mounted in the bottom of the pump chamber in a sliding manner. The pump chamber is formed so as to have an annular projection, forming a stop, spaced a distance above the bottom of the chamber, which distance is greater than the vertical dimension of the seal. The seal itself is of such a dimension that when it is raised up from the bottom of the pump chamber and resting against the stop, channels exist permitting communication from an area below the seal around the outer edge of the seal between it and the wall of the pump body permitting fluid to enter the pump chamber. In its downward position, it seals against a surface of the pump body.

As a result, during the downward stroke of the pump, the pressure in the pump chamber, along with the friction of the member sealing against the flexible seal, pushes the flexible seal downward causing its lower edge to seal against the pump body: At its inner annular edge, a seal is made with the member moving downwardly, as in the prior art. At the end of the dispensing stroke, as the movable sealing member which contacts the flexible seal moves upward, it tends to drag the flexible seal along with it until the flexible seal abuts against the stop. This draws the flexible seal away from the bottom of the pump body and permits a path of communication to be established between the dip tube and the pump chamber so that the pump chamber can immediately start refilling.

Various means of forming a channel of communication are possible. The flexible seal can be made with an outer diameter which is smaller than the inner diameter of the pump body. Alternatively, channels can be formed in the inner wall of the pump body or in the outer wall of the seal.

DETAILED DESCRIPTION OF THE INVENTION

Figure 1:
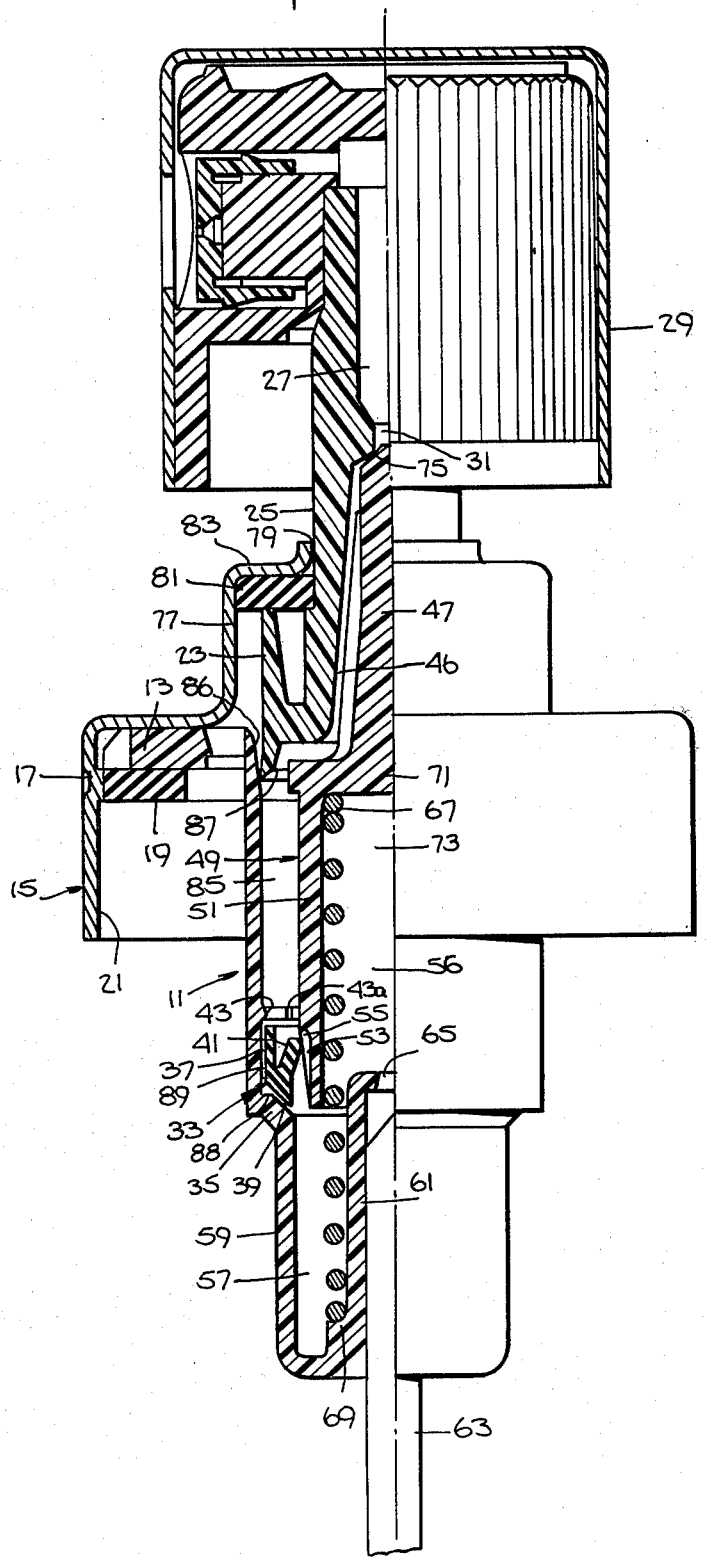
FIG. 1 is an elevation view, partially in cross-section of a first prepressurized pump having the sliding inlet seal of the present invention installed therein.

FIG. 1 is an elevation view, partially in cross-section, of a prepressurized pump having an inlet seal according to the present invention. More details concerning the manner in which such a pump operates may be found in copending Ser. No. 765,701, the disclosure of which is hereby incorporated by reference. The pump assembly shown in the figure includes a pump body 11, preferably made of plastic. The pump body 11, includes a flange portion 13 which is disposed in a mounting cup 15. The illustrated mounting cup is made of metal. However, mounting cups of plastic are also possible. The flange 13 is designed so as to snap behind indentations 17 formed in the mounting cup. Disposed below the flange 13, is an annular gasket 19 which seals against the top of a container when the pump is mounted by crimping the downwardly depending portion 21 of the mounting cup around the lip of a metal or glass bottle.

Disposed for reciprocal motion within the pump body 11 is a piston 23. The piston 23 is integral with a dispensing stem 25 which contains a dispensing passage 27 in communication with an atomizing nozzle 29 in conventional fashion. An inlet port 31 is provided at the lower end of the passage 27.

At the bottom of a pump chamber 85 in the pump body 11, an annular flexible seal 33 is disposed. Seal 33 is preferably made of a soft plastic material. At this point, the pump body has a portion 35 which angles inwardly. In the illustrated embodiment, the annular flexible seal 33 has an outer cylindrical portion 37, a downwardly angled portion 39, which matches the angle of the angled portion 35 of the pump body, and an inwardly projecting annular sealing lip 41. In the illustrated embodiment, the outer diameter of the portion 37 is smaller than the inner diameter of the pump body at that point. Molded within the pump body 11 is an annular projection 43 which acts as a stop for the top end of the portion 37 of the annular seal.

The piston 23 and stem 25 form a piston and stem assembly 45 which has a central opening 46 therein. Projecting into central opening 46 is the upper part 47 of a valve member 49, preferably made of plastic. The valve member also has a lower portion 51 of a cylindrical shape which projects through the throat formed by the annular inwardly projecting sealing portion 41 of the annular seal 33. For proper sealing, one of the two members, i.e., the seal 33 and valve member 49, should be softer than the other. Typically the seal 33 will be made of a softer plastic than valve member 44. However, the reverse is also possible. Portion 51 of the valve member 49 is of a generally cylindrical shape. However, at the bottom it contains a tapered section 53 in which is formed at least one slot 55 which bypasses the edge of the sealing portion 41 of the seal 33. In the bottom portion 51 of the valve member 49 there is a central cylindrical recess 56. In the area of the pump body below the seal 35 is an annular space 57. This annular space 57 has an outer wall 59 and an inner wall 61 both of cylindrical shape. Inserted into the space formed by the inner wall 61 is a dip tube 63 which communicates with the container on which the pump is mounted. Directly above the dip tube 63 is an inlet port 65 communicating with the recess 56 beneath the valve member 49 and also with the annular space 57. A spring 67 extends between a step 69 formed in the annular space 57 and the top surface 71 of the recess 56 beneath the valve member 49. The upper portion 47 of the valve member 49 contains a beveled portion 75 at its tip which seals against the edge of the port 31.

In an at rest position, the spring 37 acts against the valve member 49 which in turn acts against the stem and piston assembly 45 to move the piston fully upward as shown in the drawing. The piston in this position is within a section 77 of the mounting cup of reduced diameter. This section of the mounting cup contains a central opening 79 through which the stem 25 passes. As illustrated, there is a gap between the central opening 79 and the stem 25 which is necessary for venting the container. The top of the piston 25 rests against a sealing diaphragm 81 disposed between it and the top 83 of the smaller section 77 of the mounting cup 15. In the position shown,, this results in a seal to prevent leakage of material out of the pump when not in use. Venting during operation can be carried out by any of the venting arrangements illustrated in U.S. Pat. No. 4,113,145. Note also that the inside of pump chamber 85 has a taper 86 at the top. Thus, when the pump is operated the skirt 87 of piston 23 flexes inwardly. If due to excessive heat, skirt 87 takes a set to the diameter of lower part the pump chamber 85, it would lose contact with the taper 86.

In the prior art, such as that shown in Ser. No. 765,701, the seal 33 was fixed in place within the pump body. Between this seal 33, the piston 23 and the walls of the pump body 11, the pump chamber 85 is formed. In the prior art arrangement, on the dispensing stroke, as the bottom portion 51 of the valve member 49 is moved downward, the passage or channel 55 is closed off and material within the pump chamber 85 is pressurized. As pressure builds up, the valve member 49 moves downward to move the bevel 75 away from the port 31 to let fluid be dispensed when a certain predetermined pressure is reached. On the return stroke the seal between the member 33 and the lower portion 51 of the valve member is maintained until the valve member 45 and piston 23 are almost in the fully raised position shown on the drawing, i.e., until the edge of the channel 55 has passed the edge of the member 41. Although in most cases this works perfectly well, in some instances problems result. As noted above, particularly with large pumps and certain materials a problem can arise. In addition, if the skirt 87 of the piston is not completely in contact with the wall of the pump body when fully raised, for the reasons given above, for example, air can leak into the pump chamber and proper filling will not take place. Such is possible if the pump remains in a very hot environment for a sufficient period of time.

However, in the present invention the annular flexible seal 33 is mounted within the pump body 11 in such a manner than it can slide over a short distance. Its limit of travel is established by the angled edge 35 at the bottom of pump chamber 85, and the annular projection 43 which acts as a stop. In essence, the ability to slide is accomplished by placing the projection 43 a distance above the bottom, or above the angled portion 35, which is greater than the vertical dimension of the annular seal 33 in the same direction. Thus, in FIG. 1, the annular seal is shown in its fully upward position against the stop at which point a gap 87 is open between the angled portion 39 of the seal and the angled portion 35 of the pump body 11. This gap 88 forms a passage for fluid which has filled the recess 56 and space 57. The passage is continued as one or more passages 89 in a channel or plurality of channels formed between the wall of the pump body 11 and the vertical portion 37 of the annular seal. This channel can be formed by making the outer diameter of the portion 37 smaller than the inner diameter of the pump body 11 at that point, by forming channels in the vertical portion 37 or by forming channels in the wall of the pump body 11.

With the arrangement of the present invention, on the downward or inward stroke of the piston, moving from the position shown in the drawing, the friction between the lower portion 53 of the valve member 49 and the annular seal 33 will move the seal 33 downward so that its angled portion 39 comes into abutment with the angled portion 35 forming a seal. As the piston 23 continues to move downward, the pressure in the chamber 85 above the seal 33 will act to hold it tightly against the angled portion 35 of the pump body 11. The seal between the annular projecting portion 41 and the lower part 51 of the valve member 49 will be as before and prevent communication over that path. Thus, once the annular seal 33 is seated, operation is exactly the same as in the prior art.

However, on the return stroke, as the valve member 49 begins to move upward, and with it the piston 23, it will tend to pull the annular seal 33 along with it. This effect will be enhanced by the partial vacuum which is created in the chamber 85. When this occurs, the annular seal 33 will move away from the angled portion 35 of the pump body 11 opening up the gap 88 which is in communication with the channel 89 permitting immediate refilling of the pump chamber 85 from the fluid which is in recess 57 and space 56. Naturally, as fluid is removed therefrom it will refill from the dip tube 63 through the port 65. Thus, under all conditions, the filling of the pump chamber 85 is more reliably insured.

Figure 2:
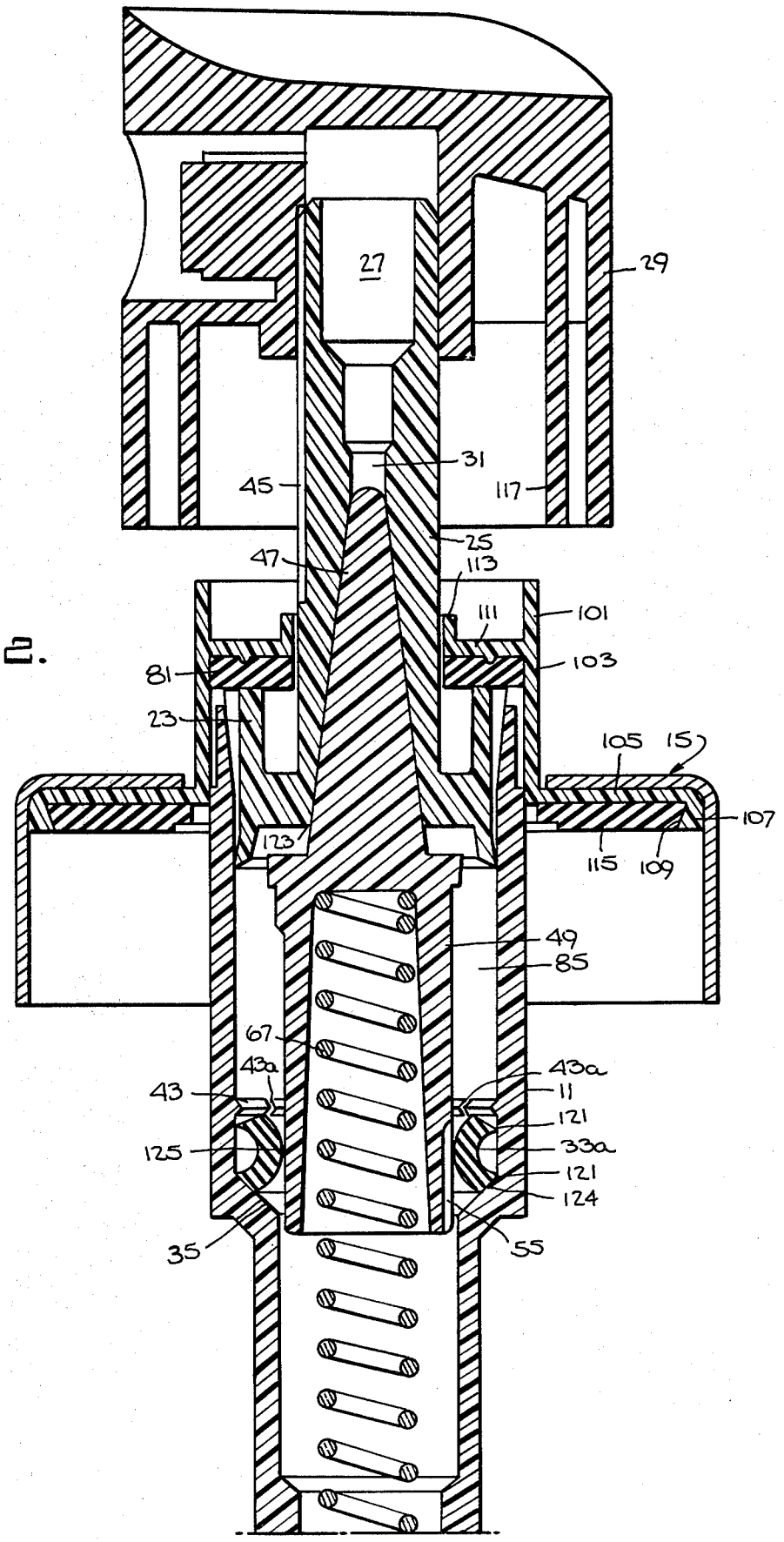
FIG. 2 is a similar view of a second embodiment of the pump of the present invention.

FIG. 2 is a cross sectional view of an additional embodiment of the present invention showing a slightly different arrangement of the prepressurized pump along with a different type of inlet seal. The parts of the pump which are the same as those previously described will not again be described in detail. In this embodiment, the mounting cup 15, which is made of aluminum, has a large central opening. Inserted through this opening is a collar 101. The collar has a cylindrical portion 103 extending from a flange 105 having a depending end portion 107 with an internal bevel 109. Near the top of the cylindrical portion 103 is an annular member 111 having an inner cylindrical portion 113 which acts as a guide for the stem 25. Directly below the annular portion 111 is the diaphragm 81. The pump body 11 contains a flange 115 which snaps into flange 105 of the collar 101 with the beveled portion 109 retaining it in place. In this embodiment, the top of the pump body 11 rests against the diaphragm 81. Also, in this embodiment, the actuator 29 contains a cylindrical guide wall 117 which cooperates with the cylindrical portion 103 of the collar to help in guiding the stem and piston as it is operating.

In addition, the upper portion 47 of the valve member has a different configuration. The stem and piston assembly 45 is formed with a tapered, conical recess into which the upper portion 47 of the valve member 49 fits without a gap.

In addition, the shape of the annular seal is different. In the embodiment of FIG. 2, a flexible seal **33*a* having a cross-section which is essentially a section of a cylinder is used. This arrangement, permits an excellent seal, in that the radius formed permits a certain amount of give and bending. As before, there is provided a projection 43 on the inner wall of the pump body 11 to limit movement of the annular seal 33*a*. Also a channel 55 is formed in the bottom portion of the valve member 49. Furthermore, as with the seal 33 of FIG. 1, channels can be formed at the inner edges 121 of the seal 33*a* to insure a passageway for fluid on the return stroke of the pump. Alternatively, these can be formed in the wall of the pump body. The projection 43 also has gaps 43*a*** therein to insure a proper path during refilling.

Operation of the pump is basically the same as that of the pump of FIG. 1. When the actuator 29 is depressed it moves both the piston 23 and the valve member 49 downward. Pressure builds up within the pump chamber 85. Because the area at the opening 123 in the bottom of the piston 23 is smaller than the area formed at the annular seal **33*a*, there will be a differential pressure in the downward direction. When this pressure becomes great enough, it will overcome the force of the spring 67 causing the valve member 49 to move downward. As soon as this occurs, because of the taper of the upper portion 47 of the valve member 49, a gap between it and the recess in the stem and piston assembly 45 will be opened permitting fluid to flow to the outlet port 31 and then through the passageway 27 to the actuator 29. During the downward stroke, the bottom 124 of the annular seal 33*a*, because of the frictional engagement with the lower portion of the valve member 49 and the pressure within the pump chamber 85, will be held against the angled portion 35 of the pump body 11 forming a seal at that point. The radius 125 of the annular seal 33*a* seals against the wall of the valve member. On the return stroke, again, because of the differential pressure and the frictional engagement, the seal 33*a* will move upward against the projection 43 forming the stop. This will open a gap at the angled portion 35 and, due to the channels formed either in the seal 33*a* or the pump body, communication to the pump chamber 85** will be established.

What is claimed is:

1. A dispensing pump comprising: a pump body within which there is formed, by a sidewall portion, a pump chamber having an inlet defined by a flexible annular seal made of plastic installed at the inner end of said pump chamber and abutting against said sidewall portion and forming a throat; a dispensing stem operatively coupled to said piston; a valve member, of a material of a hardness different from said seal, cooperating with and guided by said throat and operatively coupled to said piston such that when said piston is in an at rest, unoperated position, communication is established between the pump chamber and the area below said throat, and when said piston is depressed, said valve member cooperates with said annular seal in said pump chamber to prevent such communication; and means biasing said valve member, piston and stem to an unoperated, at rest position; the annular seal in said pump chamber being mounted for sliding motion therein along said sidewall portion between a first inward position where it seals against said pump body and a second outward position where it establishes a path of communication from below said throat into said chamber, a gap between the inner end of said pump body and the bottom of said flexible seal and at least one channel bridging the remainder of said seal; an annular projection formed on the inside of said sidewall of said pump chamber, spaced from the inner end of said chamber a distance greater than the dimension of said annular seal in the same direction limiting the sliding motion of said annular seal; said annular seal comprising a vertical portion of an outer diameter at least slightly less than the inner diameter of said pump chamber, a second portion extending inwardly and downwardly therefrom and a third sealing portion extending upwardly and inwardly from said inwardly and downwardly extending portion and forming a sealing edge contacting said valve member, the inner end of said pump chamber extending downwardly at the same angle as said inwardly and downwardly extending portion whereby during pump operation a seal will be made between said inwardly and downwardly extending portion and said inner end of said pump chamber.

2. A dispensing pump comprising: a pump body within which there is formed, by a sidewall portion, a pump chamber having an inlet defined by a flexible annular seal made of plastic installed at the inner end of said pump chamber and abutting against said sidewall portion and forming a throat; a dispensing stem operatively coupled to said piston; a valve member, of a material of a hardness different from said seal, cooperating with and guided by said throat and operatively coupled to said piston such that when said piston is in an at rest, unoperated position, communication is established between the pump chamber and the area below said throat, and when said piston is depressed, said valve member cooperates with said annular seal in said pump chamber to prevent such communication; and means biasing said valve member, piston and stem to an unoperated, at rest position; the annular seal in said pump chamber being mounted for sliding motion therein along said sidewall portion between a first inward position where it seals against said pump body and a second outward position where it establishes a path of communication from below said throat into said chamber, a gap between the inner end of said pump body and the bottom of said flexible seal and at least one channel bridging the remainder of said seal, an annular projection formed on the inside of said sidewall of said pump chamber, spaced from the inner end of said chamber a distance greater than the dimension of said annular seal in the same direction limiting the sliding motion of said annular seal; said pump body having an angled portion at said inner end of said pump chamber, said annular seal in cross section at its circumference having an inner curved surface, an outer curved surface concentric thereto and two flattened edges joining said inner and outer curved surfaces, said inner curved surface contacting said valve member to form a seal at that point, one of said flat edges, having an angled portion matching the angled portion of said inner end and when said pump is being operated, abutting against said angled portion, and the intersection of the other flat edge and said other curved surface resting against the sidewall portion of said pump chamber, whereby when in a fully inward position, said annular seal will seal against said angled portion of said pump body.

3. The pump according to claim 1 or 2 wherein said pump is an atomizing pump, said piston and dispensing stem being formed as an integral unit containing a central recess therein communicating with a central port in said stem on the other side of which is the dispensing outlet of said stem and wherein said valve member comprises a member having a first inner cylindrical section cooperating with said annular seal and a second outer portion acting to seal off said port, said biasing means comprising a spring acting against said valve member, said valve member in turn acting against said integral dispensing stem and piston at said port to tend to maintain said dispensing stem and piston in a fully raised, unoperated position.

4. The pump according to claim 3 wherein said pump body forms an annular chamber inwardly of said seal and said angled portion, said annular chamber having inner and outer cylindrical walls, a dip tube inserted in the inner cylindrical wall of said chamber, and further including a port in said pump body above said dip tube, and wherein said first, inner portion of said valve member is hollow forming a recess, said recess being in communication with said annular chamber whereby during filling, fluid will move from said dip tube to said recess, from said recess to said annular chamber and thence through the channel formed between said annular seal and said valve body to refill said pump chamber.

5. The pump according to claim 1 or 2 wherein said channel comprises a gap between outer diameter of said annular seal and the inner diameter of the adjacent portion of said pump body.

6. The pump according to claim 1 or 2 wherein said channel comprises at least one bypass channel formed in said annular seal.

7. The pump according to claim 1 or 2 wherein said channel comprises at least one bypass channel in the side wall of said pump body adjacent said annular seal.

8. The pump according to claim 3 wherein said integral dispensing stem and piston contain a central, tapered conical recess below said central port and wherein said second upper portion of said valve member has a shape matching that of said recess such that when biased against said recess by said biasing means said upper portion will be in contact with said conical recess, the cross-sectional area at the point where said upper portion enters said recess being less than the cross-sectional area at said annular seal, whereby as pressure develops in said pump chamber, a differential pressure will act on said valve member to move it downward whereby, because of said taper, a passage will be open to said port.

* * * * *